United States Patent [19]

Hofbauer

[11] 4,222,358

[45] Sep. 16, 1980

[54] FUEL INJECTION SYSTEM

[75] Inventor: Peter Hofbauer, Wolfsburg, Fed. Rep. of Germany

[73] Assignee: Volkswagenwerk Aktiengesellschaft, Wolfsburg, Fed. Rep. of Germany

[21] Appl. No.: 966,566

[22] Filed: Dec. 5, 1978

[30] Foreign Application Priority Data

Dec. 10, 1977 [DE] Fed. Rep. of Germany ..... 2755222

[51] Int. Cl.[3] ..... F02M 39/00; F02M 47/02

[52] U.S. Cl. ..... 123/495; 239/92

[58] Field of Search ..... 123/139 AK, 139 AT, 123/139 AS, 32 JV; 239/92, 88

[56] References Cited

U.S. PATENT DOCUMENTS

| | | | |
|---|---|---|---|
| 2,015,887 | 10/1935 | Eek | 239/92 |
| 2,279,010 | 4/1942 | Nichols | 239/92 |
| 3,207,442 | 9/1965 | Kessler et al. | 239/92 |
| 3,516,395 | 6/1970 | Bassot et al. | 123/139 AK |
| 3,943,901 | 3/1976 | Takahashi et al. | 123/139 AT |
| 4,106,458 | 8/1978 | Köhler | 123/139 AK |
| 4,129,256 | 12/1978 | Bader, Jr. et al. | 123/139 AK |

FOREIGN PATENT DOCUMENTS

| | | | |
|---|---|---|---|
| 902105 | 7/1951 | Fed. Rep. of Germany | 123/139 AT |

*Primary Examiner*—Charles J. Myhre
*Assistant Examiner*—Magdalen Moy
*Attorney, Agent, or Firm*—Spencer & Kaye

[57] ABSTRACT

A fuel injection system has an injection distributor pump and a plurality of fuel injection valves supplied with pressurized fuel from the pump and projecting into the combustion chamber of respective cylinders of an internal combustion engine served by the fuel injection system. The injection distributor pump generates a fuel delivery pressure of medium magnitude. With each fuel injection valve there is associated a pressure booster for amplifying the pressure of the fuel from the value of medium magnitude to an ejection pressure required for injecting the fuel by the fuel injection valve into the respective engine cylinder.

2 Claims, 1 Drawing Figure

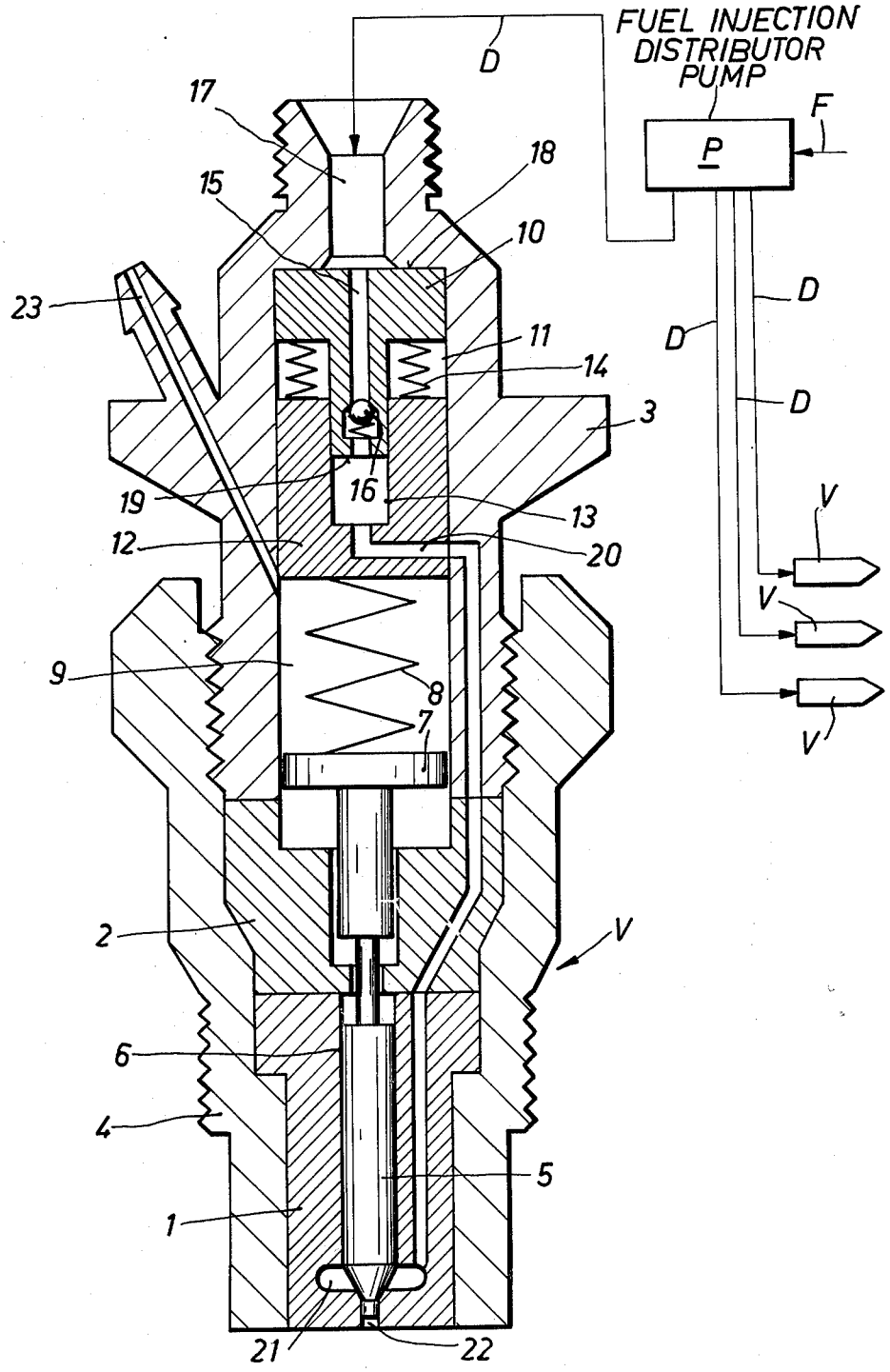
FUEL INJECTION
DISTRIBUTOR
PUMP
P
F
D
D
D
D
V
V
V
V
17
18
15
10
23
11
14
3
16
19
13
12
20
9
8
7
2
6
4
5
1
21
22

FUEL INJECTION SYSTEM

BACKGROUND OF THE INVENTION

This invention relates to a fuel injection system particularly for diesel internal combustion engines and is of the type which has an injection distributor pump and a plurality of injection valves connected to the distributor pump and projecting into the combustion chamber of each engine cylinder.

Conventional fuel injection systems for diesel engines are relatively complex and expensive to ensure that they meet the requirements pertaining to diesel engines. Particular difficulties are involved with the circumstance that relatively small fuel quantities are injected into the combustion chambers of the internal combustion engine at relatively high pressures. In order to generate such high fuel pressures, conventionally two serially arranged pumps (a pre-delivery pump and a high pressure pump) are required. Further, a precise regulation of the fuel quantities to be injected which is necessary for a disturbance-free run of the internal combustion engine in all operational conditions is very difficult because of the high pressures and small fuel quantities and could be heretofore achieved only with very substantial expense, involving the strict observation of very small manufacturing tolerances.

SUMMARY OF THE INVENTION

It is an object of the invention to provide a fuel injection system of the above-outlined type which meets the usual requirements involved in diesel engines with simpler and more economical means.

This object and others to become apparent as the specification progresses, are accomplished by the invention, accordng to which, briefly stated, the fuel injection distributor pump is designed for generating a delivery pressure of medium magnitude and further, with each injection valve there is associated a device for boosting the pressure to a magnitude required for the fuel ejection by the nozzle of the fuel injection valves.

Thus, in the fuel injection system according to the invention, the high fuel pressure required for the fuel ejection is no longer generated directly by the pump, but by pressure boosters, one associated with each injection valve. Each pressure booster amplifies the pump pressure of medium level to the desired high ejection pressure level, while, at the same time, the delivered fuel quantity varies at an inverse ratio. The fuel pump required for such a fuel injection system thus only has to generate a pressure of medium magnitude and thus is capable of handling larger fuel quantities; both characteristics are conditions which make possible a significantly higher precision in the fuel regulation.

According to a preferred embodiment of the invention, the pressure booster, expediently incorporated in each fuel injection valve, comprises a slidably supported stepped piston, whose larger end face is exposed to the pressure generated by the injection distributor pump, whereas its smaller end face is in communication with a conduit system leading to a fuel ejection opening in the nozzle of the injection valve. Expediently, the stepped piston is supported in the nozzle holder of the injection valve. In this embodiment the high ejection pressure is prevailing only in the conduit system arranged in the nozzle holder, while the conduits between the pump and the several injection valves are exposed to the fuel pressure of medium magnitude. In this manner the unfavorable feedback effects on the injection system caused by elasticities in the conduits are largely avoided. According to a further advantageous feature of the invention, the stepped piston has a central axial bore containing a check valve which closes in a direction opposing the force derived from the pressure generated by the injection pump, so that the fuel supply is effected directly through the stepped piston.

BRIEF DESCRIPTION OF THE DRAWING

The sole FIGURE illustrates, in longitudinal section, a fuel injection valve which incorporates a preferred embodiment of the invention and which forms part of an only schematically illustrated fuel injection system.

DESCRIPTION OF THE PREFERRED EMBODIMENT

Turning now to the FIGURE, the fuel injection system schematically shown therein comprises a conventional fuel injection distributor pump P which receives fuel from a fuel line F and delivers the fuel in predetermined timing through delivery lines D to individual fuel injection valves V, each projecting into the combustion chamber of the cylinders of an internal combustion engine, particularly a diesel engine.

Each fuel injection valve V has a nozzle body 1 which, together with an intermediate part 2, is tightened to a nozzle holder 3 by means of a sleeve nut 4. A nozzle needle 5 is axially displaceably and sealingly supported in an axial bore 6 of the nozzle body 1 and is attached to a spring seat disc 7 located in a cylindrical space 9 of the nozzle holder 3. A return spring 8 is arranged in the space 9 and is in engagement with an end face of a block 12 (accommodated in the nozzle holder 3) and the spring seat disc 7 for biasing the needle 5 into the "nozzle closed" position. The intermediate component 2 serves for limiting the stroke of the nozzle needle 5.

In the nozzle holder 3 there is displaceably supported a stepped (differential) pistion 10 whose larger piston land slides in a bore 11 of the nozzle holder 3, bounded at one end by the block member 12. The smaller piston land of the stepped piston 10 slides in a bore 13 provided in the block member 12. The stepped piston 10 is biased by a spring 14 which, with one end, engages the block member 12 and is, with its other end, in contact with an annular shoulder of the stepped piston 10. The stepped piston 10 has a throughgoing bore 15 which contains a check valve 16 through which a fuel supply channel 17, coupled with the delivery conduit D of the fuel pump P is in communication with a conduit system 20 formed of serially coupled conduit portions contained inside the block member 12, the nozzle holder 3, the intermediate component 2 and the nozzle body 1. The conduit system 20 merges into a pressure chamber 21 in the zone of the tip of the nozzle needle 5, immediately upstream of the ejection opening 22 of the nozzle 1. A port 23 communicating with the cylindrical chamber 9 serves for removing leakage oil.

By providing, according to the invention, the stepped piston 10 in the nozzle holder 3 of each fuel injection valve V, it is feasible to operate the upstream-connected fuel distributor pump P at a relatively low supply pressure. This, in turn, makes possible the use of a pump of relatively simple structure, such as a vane chamber pump or a gear pump associated with an appropriate distributor system. The amplification of the pressure delivered by the pump P to the required ejection pressure is effected by the stepped piston 10 which boosts the pressure as a function of the surface area ratio of the two end faces 18 and 19. At the same time, a decrease in the delivered fuel quantities is effected, so that the distributor system operates not only at relatively low pressures, but also with relatively large delivered quantities which, from the technological point of view, is much easier to achieve than a distribution at high pressures and small quantities as it has been the case heretofore. For example, in a fuel injection valve where the ejection pressure is about 200 up to 1000 bar, the pressure delivered by the injection distributor pump, may be about 20 up to 100 bar, respectively.

In the description which follows, one operational cycle of the fuel injection valves V will be set forth, starting with the phase in which the structure has a position as shown in the FIGURE.

As the fuel supply channel 17 is exposed to pressure from the pump P, first the stepped piston 10 is pressed downwardly against the force of the spring 14 and, as a result, in the conduit system 20 an increased fuel pressure is set forth which is a function of the surface area ratio of the opposite end faces 18 and 19 of the stepped piston 10. The thus pressurized fuel lifts the nozzle needle 5 against the force of the return spring 8, whereupon through the nozzle opening 22 an appropriate fuel quantity is injected into the combustion chamber of the respective engine cylinder, dependent upon the momentary operational condition of the engine. Such a fuel metering which is effected by known means upstream of the fuel injection valves V, can thus be performed, by virtue of the invention, on a fuel which has a relatively low pressure and which is delivered in relatively large quantities (as a function of the surface area ratio of faces 18 and 19) as compared to the ejection characteristics of the fuel injection valves. This makes it possible to meter the fuel with a technologically simpler structure having lower requirements concerning manufacturing tolerances. At the same time, the high ejection pressure is limited to the relatively short channels worked into the compact parts of the fuel injection valves; in this manner the influence of conduit elasticities is substantially reduced.

Subsequent to the injection of the predetermined fuel quantity through the nozzle opening 22 into the respective engine cylinder, the pressure in the conduit system 20 and the pressure chamber 21 again drops so that the nozzle needle 5 biased by the return spring 8 is moved by the latter into its closed position in which the nozzle opening 22 is blocked. Since, at the same time, there occurs a depressurization in the fuel supply channel 17, the stepped piston 10 is returned by the spring 14 into its position shown in the FIGURE. During this return motion of the stepped piston 10, the check valve 16, which has been heretofore in its closed position, opens since the pressure in the bore 15 overcomes the force of the check valve spring and, as a result, fuel may be resupplied from the fuel supply channel 17 into the conduit system 20. The fuel injection valve has then resumed its initial position as shown in the FIGURE and is ready to perform a successive injection cycle.

It is to be understood that the above description of the present invention is susceptible to various modifications, changes and adaptations and the same are intended to be comprehended within the meaning and range of equivalents of the appended claims.

I claim:

1. In a fuel injection system having an injection distributor pump, a plurality of fuel injection valves each having a fuel injection nozzle including a nozzle opening; a conduit system arranged within each fuel injection valve and leading to said nozzle opening; and fuel supply means carrying pressurized fuel from the pump to the fuel injection valves projecting into the combustion chamber of respective cylinders of an internal combustion engine served by the fuel injection system; the improvement wherein said injection distributor pump generates a fuel delivery pressure of medium magnitude; and further wherein with each said fuel injection valve there is associated a pressure booster means for amplifying the pressure of the fuel from the value of medium magnitude to an ejection pressure required for injecting fuel by the respective fuel injection valve into the respective engine cylinder; each pressure booster means comprising a slidably supported stepped piston having oppositely oriented end faces of unlike effective areas and a return spring biasing said stepped piston in one direction; the relatively large end face of the stepped piston being in communication with said fuel supply means for exposure to said fuel delivery pressure of medium magnitude against the force of said return spring and the relatively small end face of the stepped piston being in communication with said conduit system; the improvement further comprising means defining a throughgoing axial bore in said stepped piston and a check valve disposed in said axial bore and arranged to close said axial bore in a direction opposing the force derived from the fuel pressure generated by said injection distributor pump.

2. A fuel injection system as defined in claim 1, wherein each fuel injection valve includes a nozzle holder; and wherein said stepped piston is supported in said nozzle holder.

* * * * *